US008199964B2

(12) United States Patent
Mimura et al.

(10) Patent No.: US 8,199,964 B2
(45) **Date of Patent: *Jun. 12, 2012**

(54) SPEAKER DIAPHRAGM, SPEAKER DUST CAP, SPEAKER SUB-CONE, SPEAKER USING THESE COMPONENTS, AND ELECTRONIC APPARATUS USING THE SAME

(75) Inventors: Kazuyoshi Mimura, Mie (JP); Shinya Mizone, Mie (JP); Kenichi Ajiki, Mie (JP); Masahide Sumiyama, Mie (JP); Toru Fujii, Shiga (JP); Yoshiyuku Takahashi, Mie (JP); Nobuo Nakamura, Mie (JP); Toshihiro Shimizu, Mie (JP); Hitoshi Satou, Mie (JP)

(73) Assignee: Panasonic Corporation, Osaka (JP)

( * ) Notice: Subject to any disclaimer, the term of this patent is extended or adjusted under 35 U.S.C. 154(b) by 964 days.

This patent is subject to a terminal disclaimer.

(21) Appl. No.: 11/909,038

(22) PCT Filed: Feb. 9, 2007

(86) PCT No.: PCT/JP2007/052313

§ 371 (c)(1),
(2), (4) Date: Sep. 18, 2007

(87) PCT Pub. No.: WO2007/097206

PCT Pub. Date: Aug. 30, 2007

(65) Prior Publication Data

US 2009/0080687 A1 Mar. 26, 2009

(30) Foreign Application Priority Data

| | | |
|---|---|---|
| Feb. 20, 2006 | (JP) | 2006-042148 |
| Feb. 20, 2006 | (JP) | 2006-042149 |
| Feb. 20, 2006 | (JP) | 2006-042150 |
| Nov. 2, 2006 | (JP) | 2006-298633 |
| Dec. 13, 2006 | (JP) | 2006-335407 |

(51) Int. Cl.
*H04R 1/00* (2006.01)

(52) U.S. Cl. ..... 381/428; 381/426

(58) Field of Classification Search ..... 381/428
See application file for complete search history.

(56) References Cited

U.S. PATENT DOCUMENTS 6,059,926 A 5/2000 Hiroshima (Continued)

FOREIGN PATENT DOCUMENTS

JP 03-120999 5/1991

(Continued)

OTHER PUBLICATIONS

JP OA for Appliction No. 2006-042148, Dec. 28, 2010, Panasonic Corp.
JP OA for Appliction No. 2006-042149, Dec. 28, 2010, Panasonic Corp.
JP OA for Appliction No. 2006-042150, Dec. 28, 2010, Panasonic Corp.

(Continued)

*Primary Examiner* — David S. Warren
(74) *Attorney, Agent, or Firm* — RatnerPrestia

(57) ABSTRACT

A loudspeaker of high sound quality is achieved by improving rigidity of a material used for a diaphragm, a dust cap and a sub-cone. The diaphragm, the dust cap and the sub-cone of the loudspeaker are made of a paper beaten with the material containing bamboo fibers obtained from a bamboo tree aged one year or older, of which the fibers are finely beaten to an extent of micro-fibrillated form. The diaphragm and the dust cap are also made with a beaten paper containing at least 2 wt % of "A fibers" having stems of no greater than 30 μm in diameter, and surfaces of the stems are fibrillated into shaggy branches having diameters of 1 μm or less.

45 Claims, 5 Drawing Sheets

U.S. PATENT DOCUMENTS

| | | | |
|---|---|---|---|
| 7,510,627 | B2 | 3/2009 | Uryu et al. |
| 2007/0131478 | A1 | 6/2007 | Okazaki et al. |

FOREIGN PATENT DOCUMENTS

| | | | |
|---|---|---|---|
| JP | 04-010800 | | 1/1992 |
| JP | 04-367198 | | 12/1992 |
| JP | 5-211696 | | 8/1993 |
| JP | 07-329245 | A | 12/1995 |
| JP | 2000-324591 | A | 11/2000 |
| JP | 2003-012936 | A | 1/2003 |
| JP | 2003-027388 | A | 1/2003 |
| JP | 2003-230197 | A | 8/2003 |
| JP | 2004-357130 | A | 12/2004 |
| JP | 6-66196 | | 9/2005 |
| JP | 2005-236497 | A | 9/2005 |
| JP | 2005-252775 | | 9/2005 |
| JP | 2005-269427 | A | 9/2005 |
| WO | WO 2005/079110 | A1 | 8/2005 |

OTHER PUBLICATIONS

JP OA for Appliction No. 2006-298633, Dec. 28, 2010, Panasonic Corp.

JP OA for Appliction No. 2006-335407, Dec. 28, 2010, Panasonic Corp.

Tetsuzo Tono, "Chemical studies on bamboo fiber as a raw material for pulp," Department of Agricultural Chemistry, College of Agricuture, (Recieved Aug. 10, 1962), vol. 14, Series B, The University of Osaka Prefecture, Sakai, Osaka, Japan (with English abstract).

Chineese Office Action for 2007800000812.7, Mar. 23, 2011.

Nobuya Takahashi et al., Development of green composites using microfibrillated celluose extracted from bamboo, Bamboo Journal, Japan Bamboo Society, Mar. 2005, pp. 81-92, ISSN 0289-2111, Japan.

International Search Report for Application No. PCT/JP2007/052313 date Feb. 9, 2007.

SPEAKER DIAPHRAGM, SPEAKER DUST CAP, SPEAKER SUB-CONE, SPEAKER USING THESE COMPONENTS, AND ELECTRONIC APPARATUS USING THE SAME

This application is a U.S. National Phase Application of PCT International Application PCT/JP2007/052313.

TECHNICAL FIELD

The present invention relates to loudspeaker diaphragms, loudspeaker dust caps and loudspeaker sub-cones constituting loudspeakers used for a variety of audio products. The invention also relates to loudspeakers using the loudspeaker diaphragms, the loudspeaker dust caps and the loudspeaker sub-cones, and electronic apparatuses equipped with these loudspeakers.

BACKGROUND ART

In the audio industry today as well as the car industry for installing audio products, the quality of sound reproduced by loudspeakers is improving at a drastic speed with the prevalence of digital products. In these industries, the trend in loudspeakers is to advance high sound quality, weight reduction and harmonization with the environment.

With regard to the high sound quality, there is an important and pressing need for development of diaphragms, dust caps and sub-cones, which are the principal components of loudspeakers having significant degrees of influence in determining the sound quality, in order to satisfy the demand of users for the quality of sound. In development of these diaphragms, the research and development are being made with priority given to beaten type papers for the reason of easiness of controlling the sound quality more accurately.

FIG. 9 is a flowchart showing a method of manufacturing diaphragms and dust caps for loudspeakers using the conventional wet-lay papermaking.

As shown in FIG. 9, pulp used as the material of diaphragms and dust caps for loudspeakers is supplied to a beater filled with water, and it is finely beaten for a few days. The pulp then undergoes a chemical treatment process, in which it is admixed with a dyestuff, a binder, a fixing agent and the like substances, followed by a papermaking process comprising the steps of pouring the pulp into a vat, diluting, dispersing and wet-laying to form a beaten sheet of paper. Thereafter, a certain proportion of water in the sheet is evaporated in a dewatering process, or the first step of the drying process, and the sheet is then thermally compressed with a press in a compressing process to further promote evaporation of the water while improving the uniformity. Finally, the sheet is punched with a cutting die in a cutting process, or the last step, to remove an outer peripheral portion not necessary for a loudspeaker diaphragm and a center hole portion for insertion of a voice coil, to produce the loudspeaker diaphragm formed of the beaten sheet of paper. In the like manner, the sheet is punched with a cutting die to remove an outer peripheral portion not necessary for a loudspeaker dust cap, to thus produce the loudspeaker dust cap formed of the beaten sheet of paper.

When necessary, a sound quality conditioner may be additionally coated or impregnated by means of dipping or spraying between the compressing process and the die-cutting process, or after the die-cutting process. The above processes complete the conventional loudspeaker diaphragm and the loudspeaker dust cap.

Although the method of manufacturing the loudspeaker diaphragm and the dust cap discussed above includes the step of compressing the sheet of paper after the papermaking process, there also exist some un-pressed loudspeaker diaphragms and dust caps not subjected to the compressing process. There is not a considerable difference, however in the method of using the sound quality conditioner for making the un-pressed loudspeaker diaphragms and dust caps.

The raw material to be beaten in FIG. 9 is a cooked, unbleached or bleached pulp as used hitherto. If loudspeaker diaphragms are manufactured from fibers that are beaten only with a beater or the like equipment, they are weak in strength and small in modulus of elasticity, so that they bear a number of problems for use as the loudspeaker diaphragms with respects to the strength as well as their sound quality. Various studies have been made in the efforts of resolving the above problems. Patent document 1 below is one of the prior art documents known to be related to such studies.

Kraft pulp obtained from coniferous trees through the cooking process has hitherto been used as the material of beaten papers for diaphragms and dust caps, and this tends to accelerate the shortage of coniferous trees. It is for this reason that the use of environmentally friendly materials is necessary and indispensable in the future. Patent document 2 is known to be related to one such study among other prior art documents.

The diaphragms, dust caps and sub-cones composed of beaten papers, mainly of such paper materials as the kraft pulp obtained from coniferous trees, tend to have low rigidity in general due to inherent properties of the materials, as compared to diaphragms, dust caps and sub-cones composed of metallic materials and resin materials. It is difficult to improve rigidities of the conventional diaphragms, dust caps and sub-cones composed of papers due to the material nature. Loudspeakers made of these diaphragms, dust caps and sub-cones therefore have a shortcoming that they are not suitable for reproduction of sound with high clarity, which is one of the features essential to high sound quality, high power output and high reliability.

Patent document 1: Japanese Patent Unexamined Publication, No. 2003-230197

Patent document 2: Japanese Patent Unexamined Publication, No. 2000-324591

SUMMARY OF THE INVENTION

The present invention covers diaphragms, dust caps and sub-cones for loudspeakers made of papers beaten of a material composed mainly of a plant, wherein the beaten papers used for the diaphragms, the dust caps and the sub-cones include a material obtained from a bamboo tree aged one year or older, of which fibers are beaten to an extent of micro-fibrillated form. This structure can improve interweaving of the bamboo fibers with other materials to obtain the sufficient rigidity and toughness required for the diaphragms, the dust caps and the sub-cones for loudspeakers since the papers are made of the micro-fibrillated form of fine bamboo fibers obtained from one year or older bamboo tree that has well-matured to have the rigidity and toughness.

In addition, the diaphragms and the dust caps for loudspeakers of the present invention contain at least 2 wt % of fibers having stems of no greater than 30 μm in diameter, of which the stem surfaces are so fibrillated that shaggy branches of the fibrillated fibers measure 1 μm or less in diameter (hereinafter referred to as "A fibers"). The above structure can provide the diaphragms and the dust caps with higher acoustic velocities and larger internal losses, thereby realizing the loudspeakers of high sound quality.

As discussed, the present invention can improve physical properties of the material of the diaphragms, the dust caps and the sub-cones for loudspeakers, thereby achieving improvement of their rigidities and Young's modulus. When employed, the diaphragms of the present invention can provide the loudspeakers with high sound quality, high output power and high reliability. In addition, the present invention can provide the diaphragms, the dust caps and the sub-cones made of the beaten papers for loudspeakers, which are low in the cost and friendly to the global environment.

REFERENCE MARKS IN THE DRAWINGS

Figure 1:
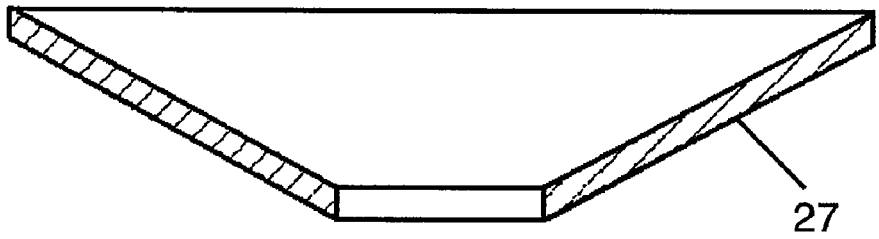
FIG. 1 is a schematic drawing showing a diaphragm for a loudspeaker according to a first exemplary embodiment of the present invention.

| | |
|---|---|
| 21 | magnet |
| 22 | upper plate |
| 23 | yoke |
| 24 | magnetic circuit |
| 25 | magnetic gap |
| 26 | frame |
| 27 | loudspeaker diaphragm |
| 28 | voice coil |
| 29 | edge |
| 30 | loudspeaker dust cap |
| 33 | loudspeaker sub-cone |
| 40 | loudspeaker |
| 41 | enclosure |
| 42 | amplifier |
| 43 | player |

DETAILED DESCRIPTION OF PREFERRED EMBODIMENTS

Presently, materials of beaten papers used for loudspeaker diaphragms are mainly of coniferous trees, and this tends to accelerate the shortage of coniferous trees in the global scale. On the other hand, there is abundance of bamboo both in the species and amounts all over the world because of their vigorous propagation and speedy growth, and there are even voices of concern about potential damages to the natural vegetation caused by expansion of bamboo forests in certain regions.

Bamboo trees grow very fast as compared to coniferous trees that they come to have stable physical properties including rigidity and toughness after having reached ages of one year or older, although they lack both the rigidity and toughness during their ages of bamboo shoots when they are about one year old or less. Bamboo trees have an advantage that they can be used for food as soon as they sprout up, for their growing speed is incomparably faster than that of the coniferous trees. Bamboo trees also have another advantage that they quickly regrow as before even after having been cut down, so as not to run into a situation of adversely affecting the global environment like the case of deforestation of coniferous forests. It is rather favorable for the earth environment to deforest excessively propagated bamboo forests and prevent the damages caused by them.

Although many efforts have been made from long ago to increase uses of bamboo in various ways, bamboo shoots and immature culms one year or younger ages have been used mostly for food and materials in different areas for the reason of tenderness and easiness of processing. However, uses of highly rigid well-matured bamboo trees older than one year have been found limited only to a part of construction materials, bamboo wares, and the like because of the difficulty of processing due to the rigidity. With the demand remaining low, there is a pressing need to find new ways of using the bamboo materials.

In respect of the application to beaten paper materials for loudspeakers, some efforts have been made to use bamboo shoots and immature culms aged one year or younger because of the ease of separating bamboo fibers. Although there is a certain measure of success, the bamboo fibers have not as yet been the primary choice of materials for the paper diaphragms of loudspeakers. The reason of this is as follows. In order to bring the intrinsic features of the bamboo fibers into full play, it is more effective to use fibers of one year or older bamboo trees having high rigidity and toughness than fibers of one year or younger bamboo shoots and immature culms, which are only tender and easy to process. It had not been possible, however, to produce diaphragms, dust caps and sub-cones that can make best use of the intrinsic characteristics of bamboo fibers, and to satisfy the level of sound quality demanded by the trend, since it had been technically difficult to properly separate the fibers of well-matured bamboo trees.

However, due to the recent global environmental issues such as desertification attributable to the decrease of coniferous trees, it has now became a problem to develop new fibers that replace those of the coniferous trees. In the papermaking technique, on the other hand, a new beating method has been developed for processing certain materials that had been considered difficult to use in the past, to make papers and to form diaphragms, dust caps and sub-cones, which make good use of the characteristics of the materials.

Based on the background art discussed above, description is provided hereinafter of the present invention with reference to the drawings and exemplary embodiments which are comprised primarily of one year or older well-matured bamboo trees.

First Exemplary Embodiment

This exemplary embodiment relates to diaphragms, dust caps and sub-cones for loudspeakers made of papers beaten of a material produced from a plant as a principal component.

Figure 2:
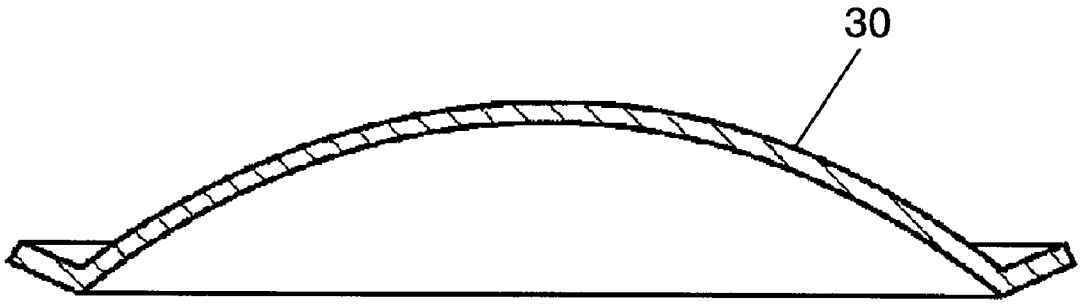
FIG. 2 is a schematic drawing showing a dust cap for a loudspeaker according to the first exemplary embodiment of the present invention.
Figure 3:
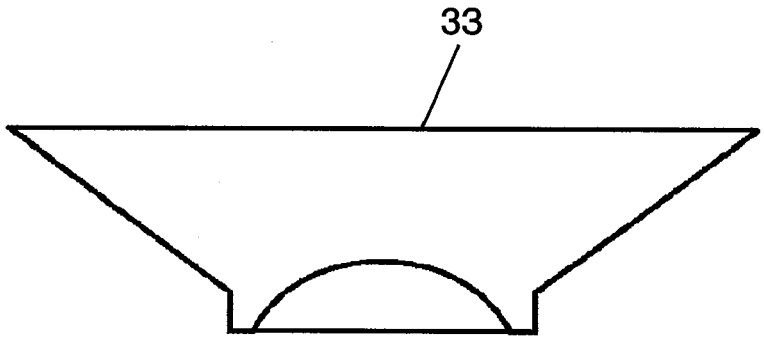
FIG. 3 is a sectional view of a sub-cone for a loudspeaker according to the first exemplary embodiment of the present invention.

FIG. 1 is a schematic drawing showing loudspeaker diaphragm 27 (hereinafter referred to simply as diaphragm 27) according to the first exemplary embodiment of this invention. As shown in FIG. 1, diaphragm 27 is made of a paper beaten of a material containing bamboo fibers obtained from a bamboo tree of one year or older age, which are beaten to an extent of micro-fibrillated form. FIG. 2 is a schematic drawing showing loudspeaker dust cap 30 (hereinafter referred to simply as dust cap 30) according to the first exemplary embodiment of this invention. As shown in FIG. 2, dust cap 30 is made of a paper beaten of a material containing bamboo fibers obtained from a bamboo tree aged one year or older, which are beaten to an extent of micro-fibrillated form. FIG. 3 is a sectional view of loudspeaker sub-cone 33 (hereinafter referred to as sub-cone 33) according to the first exemplary embodiment of this invention. As shown in FIG. 3, sub-cone 33 is made of a paper beaten of a material containing bamboo fibers obtained from a bamboo tree aged one year or older, which are also beaten to the extent of micro-fibrillated form.

As used herein, the term "micro-fibrillated form" means a condition having 200 ml or less in Canadian Standard Freeness.

It is desirable here that the bamboo fibers are micro-fibrillated to an average fiber diameter smaller than 5 μm, and a ratio L/D (i.e., average fiber length/average fiber diameter) of 10 or greater. That is, the average fiber length is made to be desirably at least 10 times the average fiber diameter.

The smaller the average diameter of the micro-fibrillated fibers the more preferred in the light of achieving better interweaving of the fibers. Likewise, the greater the ratio of L/D (average fiber length/average fiber diameter) the more preferred in the light of achieving better interweaving of the fibers.

It is also possible to provide greater effects of the interweaving by increasing the degree of beating to such an extent as to make the average fiber diameter to 1 μm or less, or even to 500 nm or less, although the time required for the beating process becomes longer. If the average fiber diameter is larger than 5 μm, the bamboo fibers tend to lack the ability to increase the interweaving among the fibers, even though they are still capable of providing diaphragm 27, dust cap 30 and sub-cone 33 with the intrinsic characteristics of the bamboo fibers.

Fibers of well-matured bamboo trees aged one year or older have high rigidity and toughness, and they are compatible with the paper pulp, which can thus improve rigidities, toughness and Young's modulus of diaphragm 27, dust cap 30 and sub-cone 33. Such bamboo fibers are finely beaten to an extent of the micro-fibrillated form before they are beaten into papers so as to facilitate further interweaving with other fibers in the paper pulp, thereby providing diaphragm 27, dust cap 30 and sub-cone 33 with sufficient rigidities and toughness, and improving their Young's modulus.

As discussed herein, the bamboo fibers can be made from any plant without specific limitations as long as it belongs to the family of bamboo, and that any bamboo tree aged one year or older is suitable, excluding bamboo shoots and immature culms aged one year or younger. With regard to the age of bamboo, a growth period of at least one year should provide the rigidity and the toughness necessary for the present invention. In addition, bamboo trees of ages between one and four years can ensure consistent rigidity and toughness.

As a feature of sound quality, such bamboo fibers can improve a sound pressure level in the high register, to thereby provide clear and impressive quality sound in the high register. On the other hand, they can also reproduce firm and heavy bass sound in the low register. As a whole, they can provide excellent quality of sound with high clarity and clearly-contoured outstanding auditory image localization.

Another advantage of the bamboo fibers is to improve the toughness of diaphragm 27, dust cap 30 and sub-cone 33, so as to make them superior in the quality and reliability, as compared with diaphragm 27, dust cap 30 and sub-cone 33 if constructed only with an ordinary pulpwood for papers. As a result, these diaphragm 27, dust cap 30 and sub-cone 33, when used for a loudspeaker, can improve the reliability in various performances of the loudspeaker such as a resistance to high input and moisture proofing reliability, which are important for loudspeakers to be mounted in motor vehicles. Accordingly, the present invention can achieve a high sound quality, high output power and high reliability of the loudspeaker constructed of these diaphragm 27, dust cap 30 and sub-cone 33.

Furthermore, the invention can also provide diaphragm 27, dust cap 30 and sub-cone 33 made of beaten papers for use in a loudspeaker, which are low in the cost and friendly to the global environment.

Moreover, these diaphragm 27, dust cap 30 and sub-cone 33 can make better use of the advantageous characteristics inherent of the bamboo fibers when they are combined and beaten with another bamboo fiber material, of which a degree of beating, or freeness, is made larger than that of the micro-fibrillated form. Here, the bamboo fiber material of the larger degree of beating means it has the freeness of at least 200 ml, and more preferably from 400 ml to 600 ml. Or, it is desirable that the bamboo fiber material of the larger degree of beating has an average fiber diameter between 5 μm and 30 μm. The advantageous characteristics inherent of the bamboo fibers can be demonstrated conspicuously when at least 40 wt % of the bamboo fibers are those having the average fiber diameter of 5 μm to 30 μm.

In this instance, the cost of the bamboo fibers becomes very expensive when the average fiber diameter is reduced to smaller than 5 μm into the micro-fibrillated form, as discussed previously. On the other hand, bamboo fibers larger than 30 μm do not help demonstrate the advantageous characteristics of the bamboo fibers.

Similarly, the advantageous characteristics of the bamboo fibers cannot be demonstrated when the ratio of bamboo fiber content is reduced to less than 40 wt %. In the presence of other constituents than the bamboo fibers, the bamboo fibers may be beaten to a degree of the micro-fibrillated form when mixed and beaten with them, so as to increase the cohesive strength to make good use of the advantageous characteristics of the bamboo fibers.

It is also practical to mix and weave with coniferous wood fibers, which have been the principal material of the beaten papers used for conventional diaphragm 27, dust cap 30 and sub-cone 33, to increase the cohesive strength and to make good use of the advantageous characteristics of the bamboo fibers. When there are constituents of materials other than bamboo fibers, an amount of the bamboo fibers may be increased to at least 40 wt % to help demonstrate the intrinsic characteristics of the bamboo fibers conspicuously.

As for the micro-fibrillated bamboo fibers having an average fiber diameter smaller than 5 μm, an amount of 0.5 wt % to 20 wt % is to be included to improve the interweaving with other materials and to increase the cohesive strength among the materials, thereby achieving better physical properties of diaphragm 27, dust cap 30 and sub-cone 33 containing the bamboo fibers. In the instance here, the intrinsic cohesion of the bamboo fibers cannot work effectively if the content of the micro-fibrillated bamboo fibers of smaller than 5 μm in the average fiber diameter is reduced to less than 0.5 wt %. On the other hand, the cost of the bamboo fibers becomes very high if the content is increased to more than 20 wt %.

The materials of diaphragm 27, dust cap 30 and sub-cone 33 are as detailed above, and description is now provided hereinafter of additives used for diaphragm 27, dust cap 30 and sub-cone 33.

Poly-lactic acid, crude rubber and polyvinyl alcohol and the like substances are some of the additives suitable for diaphragm 27, dust cap 30 and sub-cone 33 containing bamboo fibers. When added, these additives can make best use of the intrinsic properties of the bamboo fibers Poly-lactic acid and polyvinyl alcohol have a tendency to adhere to the surfaces of the bamboo fibers since they are quite compatible with the bamboo fibers. In addition, they can improve a frequency characteristic of the loudspeaker since they have an effect of increasing internal losses.

Because the poly-lactic acid, in particular, is a bio-degradable plastic, diaphragm 27, dust cap 30 and sub-cone 33 made of bamboo fibers and the poly-lactic acid can become products harmonized with the environment. Accordingly, diaphragm 27, dust cap 30 and sub-cone 33 made of beaten papers for a loudspeaker are considered friendly to the global environment. The poly-lactic acid can demonstrate a substantial effect when an amount of 1 wt % to 20 wt % is added. The inherent adhesion of the poly-lactic acid to the bamboo fibers cannot work effectively if its content is reduced to less than 1 wt %, or the cost of it becomes very high if the content is increased to more than 20 wt %.

On the other hand, polyvinyl alcohol can demonstrate a substantial effect when an amount of 2 wt % to 8 wt % is added. The inherent adhesion of the polyvinyl alcohol to the bamboo fibers cannot work effectively if the content is reduced to less than 2 wt %, or the cost of it becomes very high if the content is increased to more than 8 wt %.

Crude rubber has an effect of increasing the internal losses, which improves a frequency characteristic and decreases sound distortion of the loudspeaker, thereby improving the sound quality.

Detailed above covers the additives used for diaphragm 27, dust cap 30 and sub-cone 33, and description is further provided about coloring of diaphragm 27, dust cap 30 and sub-cone 33.

In this exemplary embodiment of the invention, a coloring agent is not used to color diaphragm 27, dust cap 30 and sub-cone 33.

Traditionally, diaphragm 27, dust cap 30 and sub-cone 33 are colored in a variety of colors according to aesthetic design and the like demand, and the coloring is usually made with such coloring agents as pigments and dyestuff. However, many of the generally used pigments and dyestuff tend to decrease the physical properties of diaphragm 27, dust cap 30 and sub-cone 33.

For this reason, there are often cases that the coloring requires a compromise with the frequency characteristic, low distortion, and even sound quality of the loudspeaker, although the aesthetic design may be improved. In addition, many coloring agents contain such substances that are harmful to the environment, which fuel the environmental contamination.

In general, colors of black tone are often used when coloring diaphragm 27, dust cap 30 and sub-cone 33. On the contrary, bamboo fibers may be colored generally with light yellow or light brown tinted colors representing an earth color and a natural color, the design of which can give a good impression in the light of environmental preservation.

Moreover, a light-color finish of yellow or the similarly-toned colors is more attractive in the sense of beautiful existence than the dark, black-tone color, so as to improve the aesthetic quality. In addition, these colors can stably maintain the exterior appearances for a long lapse of time after the coloring without much of discoloration because they are very close to the original colors of the bamboo fibers.

As described above, use of the lightly-tinted colors such as yellow tone color of this embodiment can provide diaphragm 27, dust cap 30 and sub-cone 33 with a great impact in the aesthetic design amongst many of diaphragms 27, dust caps 30 and sub-cones 33 of dark colors. Accordingly, diaphragm 27, dust cap 30 and sub-cone 33 of this exemplary embodiment of the invention can achieve an appeal of colors in some of the higher-end loudspeakers called premium models.

This embodiment can eliminate the time and materials required for the coloring process, thereby achieving low cost of diaphragm 27, dust cap 30 and sub-cone 33. In addition, this embodiment can also contribute to improvement of the quality since there is no possible defects of any kinds related to the coloring. As a result of not using any coloring agent, diaphragm 27, dust cap 30 and sub-cone 33 can conspicuously demonstrate the inherent color and the properties of the bamboo fibers.

Since pigments have substantial effects among ingredients of the coloring agent to decrease the physical properties of diaphragm 27, dust cap 30 and sub-cone 33, absence of the pigments in diaphragm 27, dust cap 30 and sub-cone 33 can demonstrate remarkably the inherent color and the properties of the bamboo fibers.

Furthermore, the above advantageous features can be demonstrated in good conditions by adjusting the lignin content in the bamboo fibers to 6% to 15%. The reason is as follows. The bamboo fibers are normally composed of about 45% of cellulose, about 25% of hemi-cellulose and about 25% of lignin. However, the lignin content usually decreases to 5% or less during the process of pulping such as chemical cooking, etc.

The bamboo fibers lose their feature of rigidity when the lignin content decreases to less than 6%. If the lignin content exceeds 15%, on the other hand, it impairs dispersibility of the bamboo fibers during the beating process before the papermaking, as well as cohesiveness when a sizing agent is used. Here, the lignin content is measured by the well-known sulfuric acid method.

It should be understood that diaphragm 27, dust cap 30 and sub-cone 33 discussed in this invention are not meant to limit use of the well-known substances such as pigments, dyestuff, sizing agents, strengthening agents, and the like.

Described next is a result of the experiment made with this invention.

In this experiment, coniferous wood fibers, bamboo fibers with a large degree of beating, and another stock of bamboo fibers reduced to the micro-fibrillated form were prepared, a number of papers were then produced according to predetermined combining ratios of the individual materials, and values of Young's modulus were measured on diaphragms 27, dust caps 30 and sub-cones 33 made from the papers. Full-range loudspeakers of a 12 cm diameter were then constructed by using these diaphragms 27, dust caps 30 and sub-cones 33, and their sound qualities were evaluated by several examiners. Table 1 shows the result of this experiment.

The evaluation of the sound qualities was conducted primarily on clearness of the sound, using the loudspeaker made of a conventional material of 100% coniferous wood pulp as the base level of which the score is reckoned at 1, with 10 being the highest score in the gradations of 1 to 10.

TABLE 1

| No. | Combining Ratio of Materials (fiber dia. in μm/length in mm) Coniferous wood | Bamboo fibers | Micro-fibrillated | Young's Modulus, E | Sound Quality Score |
|---|---|---|---|---|---|
| 1 | 100% (13/2.3) | None | None | 1,400 | 1 |
| 2 | 95% (13/2.3) | 5% (15/1.9) | None | 1,500 | 3 |
| 3 | None | 100% (15/1.9) | None | 1,600 | 5 |
| 4 | None | 95% (15/1.9) | 5% (3/1.3) | 1,750 | 7 |
| 5 | None | 95% (15/1.9) | 5% (0.9/1.0) | 1,900 | 8 |
| 6 | None | 95% (15/1.9) | 5% (0.4/0.8) | 2,050 | 9 |
| 7 | 62% (13/2.3) | 38% (15/1.9) | None | 1,550 | 5 |
| 8 | None | 80% (15/1.9) | 20% (0.4/0.8) | 2,250 | 10 |

From the result of the experiment, it is safe to note that the papers made of any combination with bamboo fibers or made only of bamboo fibers can increase values of the Young's modulus, and improve the sound quality in the same proportion to the increase when evaluated in view of the clearness of sound quality, as compared with the one made of the base material of 100% coniferous wood pulp. This tendency became more obvious when the material was combined with the bamboo fibers which had been beaten to the degree of the micro-fibrillated form, and it gave a result of proving the above explanation.

Moreover, the combining ratios of these materials, fiber diameters and fiber lengths also lead to a result of proving the above explanation.

According to the above result, diaphragm 27, dust cap 30 and sub-cone 33 using the papers made of any combination with the bamboo fiber or only of the bamboo fibers could substantially improve the clearness of sound, especially clear and firm sound in the high register. In the case of the paper containing a large amount of the bamboo fibers beaten to the degree of micro-fibrillated form, the clearness of sound was improved so exceedingly that some felt the need to modify the tone in order to improve the harshness to their ears on the condition that listening is made along the axis of the loudspeaker. The result also showed an improvement in the characteristic of sound pressure vs. frequency, making it close to flat over the frequencies, and an increase in the sound pressure level in the middle to high registers.

Second Exemplary Embodiment

A diaphragm and a dust cap of the second exemplary embodiment of this invention are made of papers beaten with 80 to 95 wt % of main fibers obtained from bamboo fibers and 5 to 20 wt % of bamboo fibers denoted as A fibers, out of the total amount of fibers.

Figure 9:
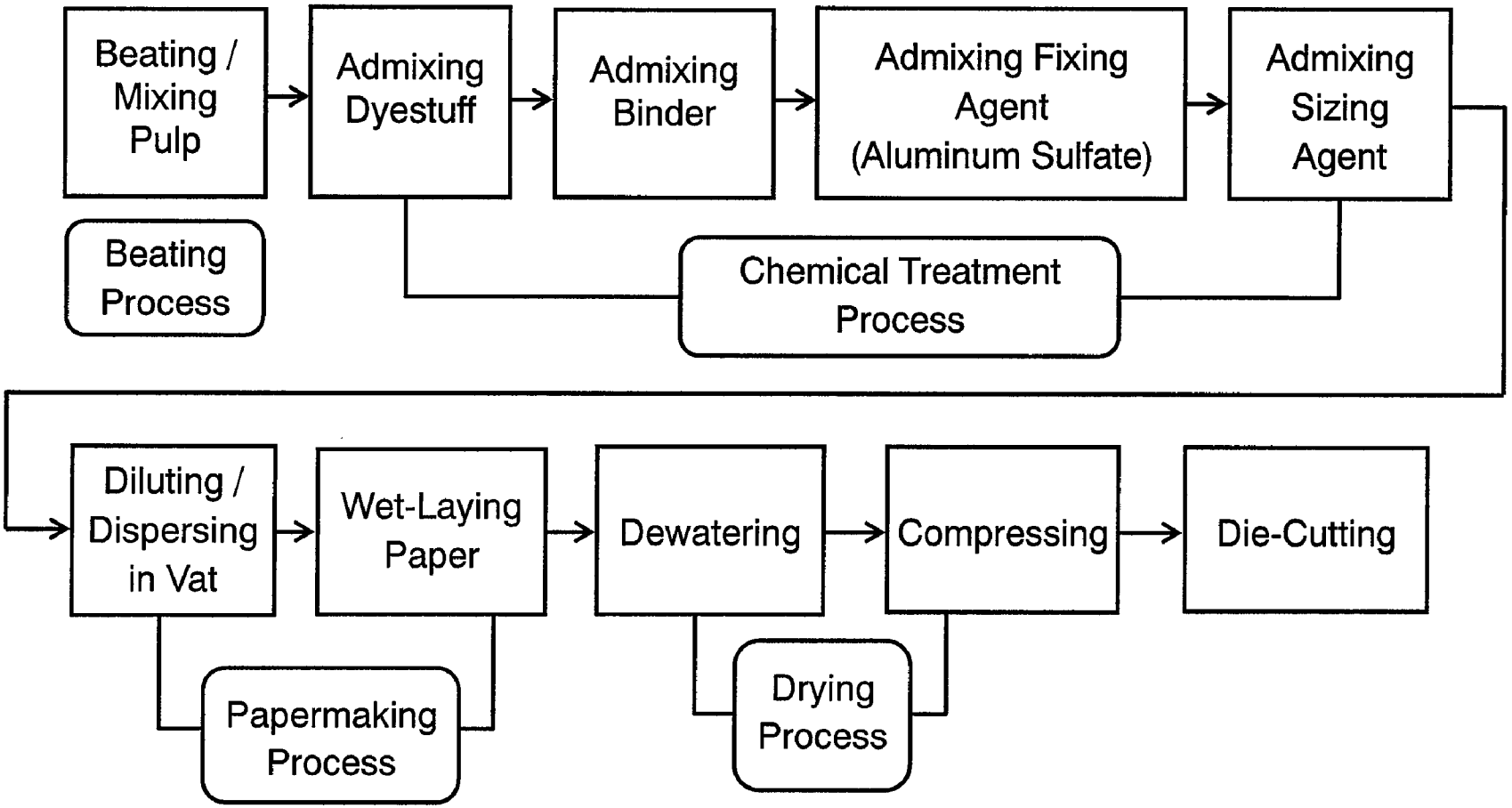
FIG. 9 is a flowchart showing a method of manufacturing diaphragms and dust caps for loudspeakers using the conventional wet-lay papermaking process.

Manufacturing processes used for the diaphragm and the dust cap made of these papers are similar to that shown in FIG. 9.

It is preferable that A fibers comprise shaggy branches, of which at least 50% have diameters of 500 nm or less, more preferably not greater than 300 nm, and the shaggy branches occupy at least 20% in volume of the A fibers.

Any of sizing agents, strengthening agents, waterproofing agents, pigments, and the like may be used if necessary. But adjustment of the sound quality is made by adding 3 to 10% of poly-lactic acid and/or crude rubber individually.

Description is provided next of embodied examples and a reference example.

Embodied Example 1

A diaphragm and a dust cap were made of papers containing 25 wt % of fibrillated bamboo fibers (i.e., A fibers formed of bamboo) combined with 75 wt % of unbleached pulp (650 ml in freeness) obtained from a coniferous tree. They recorded an acoustic velocity of 2,100 m/s and an internal loss of 0.035. Drainage was found slightly poor during the process of manufacturing.

Embodied Example 2

Figure 4:
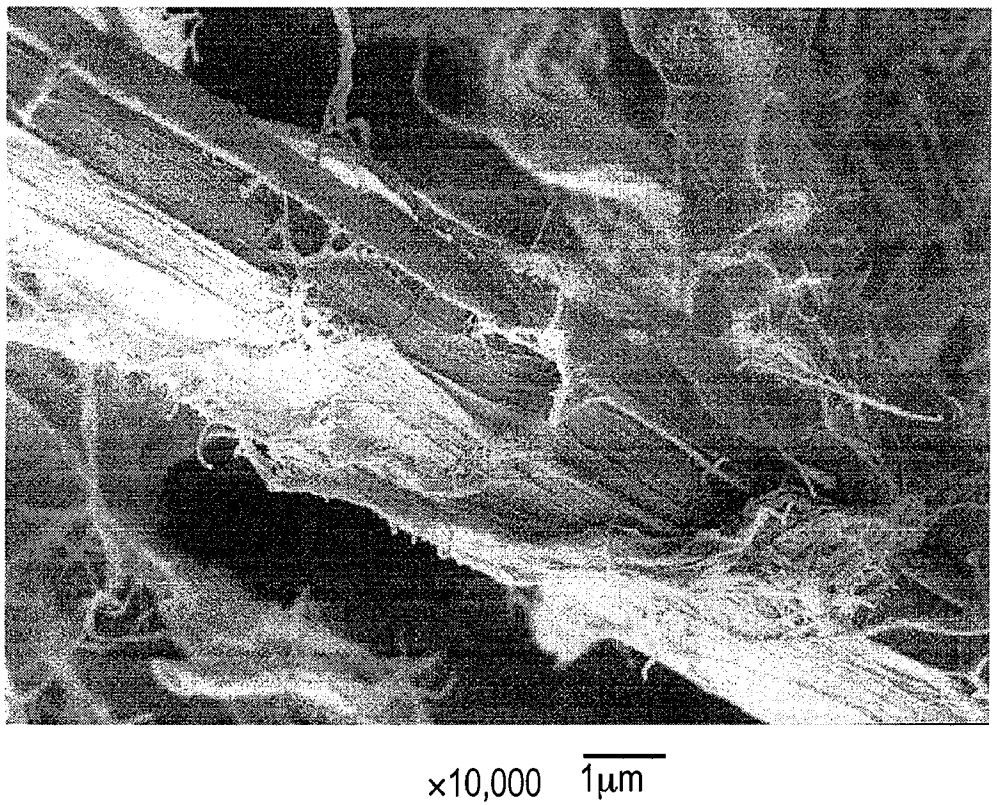
FIG. 4 is a microphotograph with a magnification of 10,000 times showing fibers used in principal portions of a diaphragm and a dust cap according to one embodied example.

A diaphragm and a dust cap were made of papers containing 5 wt % of fibers (A fibers formed of bamboo) having stems of no greater than 30 μm in diameter, of which the stem surfaces are so fibrillated that shaggy branches of the fibrillated fibers have diameters of 1 μm or less, combined with main fibers made of bamboo fibers beaten in a high-speed mixer (650 ml in freeness). They recorded an acoustic velocity of 2,380 m/s and an internal loss of 0.033. FIG. 4 shows a microphotograph of the A fibers used for the diaphragm and the dust cap of this embodied example, with a magnification of 10,000 times.

Reference Example 1

A diaphragm and a dust cap were made of papers containing 10 wt % of aramid pulp in 90 wt % of unbleached pulp (650 ml in freeness) obtained from a coniferous tree. They recorded an acoustic velocity of 1,950 m/s and an internal loss of 0.028.

As described above, it was confirmed that the diaphragms and the dust caps made of the papers containing the A fibers show higher acoustic velocities and larger internal losses than the conventional paper. The following facts were also confirmed.

That is, the diaphragm and the dust cap containing less than 2 wt % of the A fibers exhibited only a small effectiveness. Although the preferable ratio of content is from 3 wt % to 50 wt %, the most preferable ratio is between 5 wt % and 20 wt % since there was barely an improvement even when the content was increase to 50 wt % or more.

The content ratio of 5 wt % not only improves the physical strength and the modulus of elasticity but also reduces variations of the physical properties of the diaphragm and the dust cap when compared with those of the 3 wt % content.

On the other hand, the content ratio exceeding 20 wt % does not help improve much of the strength and the modulus of elasticity, but it impedes the drainage during the dewatering process, which makes the manufacturing difficult.

There is no specific restriction on the fibers used so long as they are natural fibers having stems of 30 μm or less in the diameter. However, it is preferable that they are made of bamboo in consideration of the easiness of shaggily fibrillating their surfaces. It is most effective in this case to take the method of using a high-pressure homogenizer.

Bamboo fibers have easily fibrillatable surfaces, the reason of which is so assumed that bamboo trees have a multi-layered structure with directionality in a configuration of the fibers, unlike the coniferous trees which grow by adding annual rings.

It was also confirmed that diameters of 1 μm or less is suitable for the shaggily fibrillated fibers on the surfaces of the fiber stems. If the diameters exceed 1 μm, the fibers do not interweave together to gain the sufficient strength during the papermaking process of the diaphragm and the dust cap.

It was further confirmed as to be effective and more desirable that at least 50% of the shaggy fibrillated branches on the surfaces of the A fibers have diameters of 500 nm or smaller. It is most desirable that at least 50% of the shaggy fibrillated branches have diameters of 300 nm or smaller. Papers made from such fibers were verified to further increase their rigidity when made into the diaphragm and the dust cap. This was determined by a result of visual measurement with an electron microscope.

Although the amount of fiber content to be included in the diaphragm and the dust cap during manufacturing changes depending on a ratio of the shaggily fibrillated branched portions to the stems of the A fibers, no substantial improvement is anticipated in the strength and the modulus of elasticity of the diaphragm and the dust cap even when a large amount of these combining components are included if the shaggily fibrillated portions are 20% or less in the volume. On the other hand, the effect of interweaving of the fibers decreases if the shaggy portions are 50% or more in the volume since the shaggy portions take a large space.

It is desirable that the stem portions and the shaggily fibrillated portions of the A fibers have a ratio between 4/1 and 1/1 in the volume, though this ratio may change depending on the combining ratio of the A fibers with other fibers. This was determined based on a result of visual measurement over a unit area taken in an electron microphotograph.

In this invention, although there is no teaching of any specific method for shaggily fibrillating the A fibers, some of the conceivable methods available are the use of a disc refiner, a Jordan refiner and a beater, or even a method using a stone mill capable of impressing a large shearing force. Other known methods adaptable for manufacturing the fibrillated fibers include the use of a pressure homogenizer, which has both functions of generating a large shearing force by means of crashing and promoting the micro-fibrillation by means of a pressure difference, and which the present inventors have discovered suitable for the bamboo fibers.

The present invention requires the principal pulp used as the base material besides the component made of bamboo fibers as described above, and the principal pulp can be any of synthetic fibers and natural fibers. However, bamboo fibers are still the best choice in view of the capability of improving strength and the modulus of elasticity of the diaphragm and the dust cap, as well as preservation of the environment, that is, natural fibers of the fast-growing trees are considered as sustainable resources of supply. It was confirmed consequently that a combination of the principal fibers and the A fibers, both made of bamboo fibers is the most desirable mode.

When necessary, an additive may be added to the diaphragm and the dust cap of the present invention. While there is no restriction for adding any of presently available sizing agents, strengthening agents, dyestuff and the like substances, it is desirable to use poly-lactic acid or crude rubber in the light of such additives as to be environmentally friendly. The poly-lactic acid is desirable in view of its effectiveness of improving the rigidity of the diaphragm and the dust cap, and the crude rubber is desirable in view of increasing their internal losses.

Third Exemplary Embodiment

Figure 5:
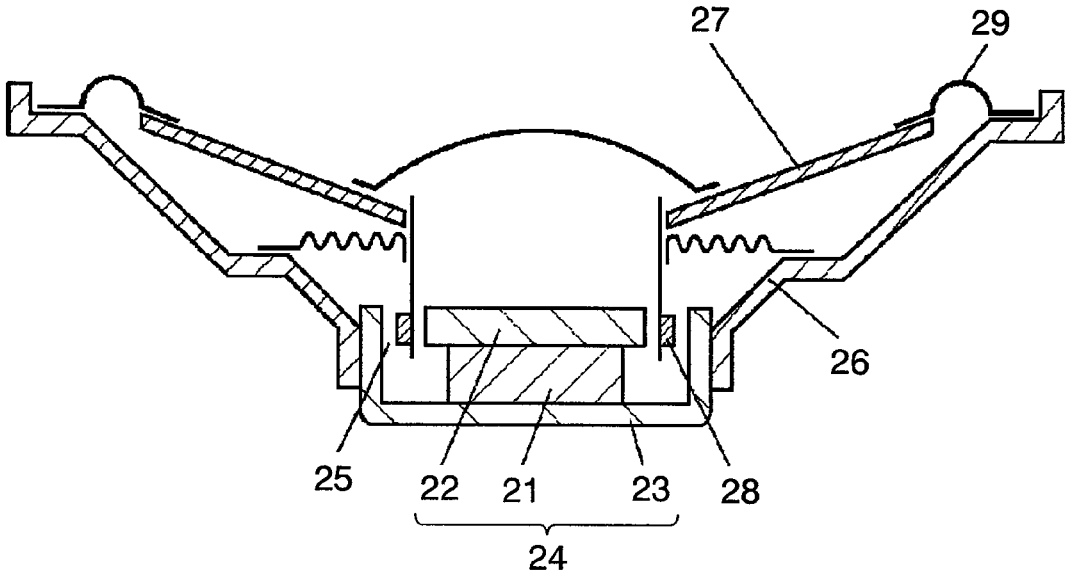
FIG. 5 is a sectional view of a loudspeaker according to a third exemplary embodiment of the present invention.

FIG. 5 is a sectional view of a loudspeaker according to the third exemplary embodiment of the present invention. As shown in FIG. 5, inner-magnet type magnetic circuit 24 is comprised of magnetized magnet 21 placed between upper plate 22 and yoke 23.

Frame 26 is connected to yoke 23 of this magnetic circuit 24. Diaphragm 27 in any of the first exemplary embodiment and the second exemplary embodiment of this invention is bonded at the periphery thereof to the outer fringe of this frame 26 through edge 29. One end of voice coil 28 is connected to a center portion of diaphragm 27, and the opposite end is coupled to magnetic circuit 24 in a manner to stay within magnetic gap 25.

Although what is taught above is an example of the loudspeaker having inner-magnet type magnetic circuit 24, this is not restrictive and that same diaphragm 27 can be adapted to a loudspeaker having an outer-magnet type magnetic circuit.

This concept is also applicable to a small size loudspeaker having diaphragm 27 integrated with edge 29.

According to this structure, the loudspeaker is constructed by using the diaphragm having sufficient rigidity and toughness as discussed in the first exemplary embodiment and the second exemplary embodiment, and the invention can thus improve a sound pressure level in the high register, to thereby provide clear and impressive quality sound in the high register. The loudspeaker can also reproduce firm and heavy bass sound in the low register.

As a whole, the loudspeaker can provide excellent quality of sound with high clarity and clearly-contoured outstanding auditory image localization. In addition, the loudspeaker realizes good tonal quality with feeling of low distortion.

As described above, the diaphragm containing bamboo fibers according to this invention is of a natural material like the material made of coniferous trees used mainly for the conventional beaten paper diaphragms. This invention thus makes possible for the loudspeaker to produce sound that is gentle to ears and excellent tonal quality by making the best use of the features of the natural materials.

This loudspeaker can also realize true and natural sound reproduction without being dominated by the uniformity of sound attributable to special tonal characteristics and resonance peculiar to synthetic materials and metallic materials. Therefore, there is rarely any reason for selecting applicable fields to which the loudspeakers are supplied, but the loudspeakers can be disseminated widely to many fields of sound making.

As another effect, this invention improves the toughness of the diaphragm, as compared to the diaphragm composed only of a paper pulp, so as to make the diaphragm superior in respect of both the quality and reliability. Accordingly, the invention can improve the reliability in various performances of the loudspeaker provided with this diaphragm such as a resistance to high input and moisture proofing reliability, which are important for loudspeakers used in motor vehicles, and maintain the aesthetic appearance and fine exterior stably for an extended period of time without much of discoloration.

The invention can thus achieve the loudspeaker of outstanding features in respect of both the quality and reliability. In addition, the invention can contribute greatly toward the environmental aspect and the cost performance.

Fourth Exemplary Embodiment

Figure 6:
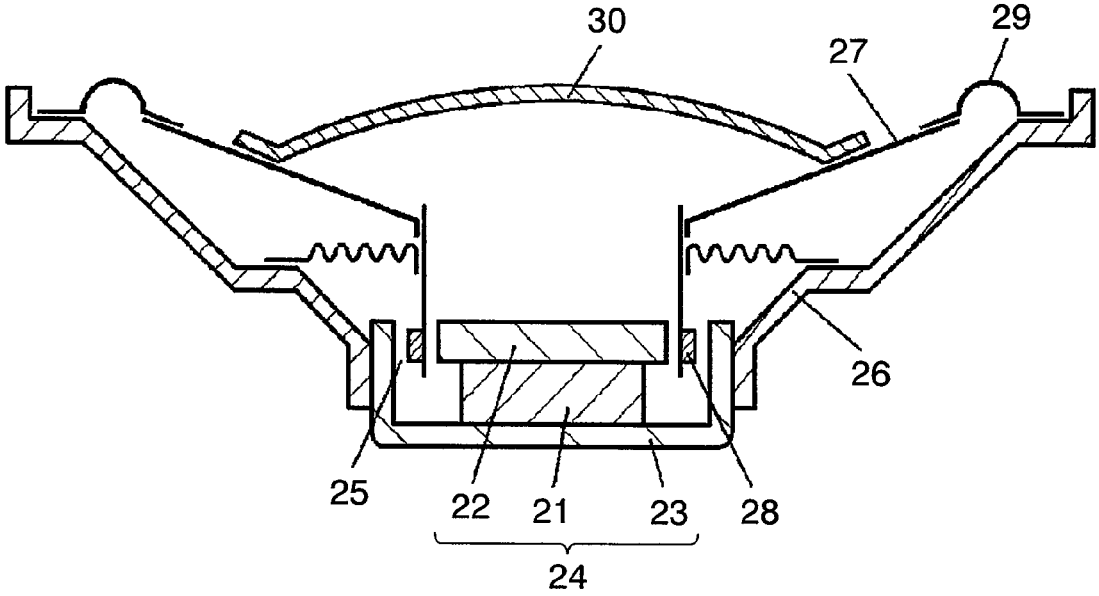
FIG. 6 is a sectional view of a loudspeaker according to a fourth exemplary embodiment of the present invention.

FIG. 6 is a sectional view of a loudspeaker according to the fourth exemplary embodiment of the present invention. As shown in FIG. 6, inner-magnet type magnetic circuit 24 is comprised of magnetized magnet 21 placed between upper plate 22 and yoke 23.

Frame 26 is connected to yoke 23 of this magnetic circuit 24. Diaphragm 27 is bonded at the periphery thereof to the outer fringe of this frame 26 through edge 29. One end of voice coil 28 is connected to a center portion of diaphragm 27, and the opposite end is coupled to magnetic circuit 24 in a manner to stay within magnetic gap 25.

Dust cap 30 in any of the first exemplary embodiment and the second exemplary embodiment of this invention is bonded to a front face portion of diaphragm 27.

Although what is taught above is an example of the loudspeaker having inner-magnet type magnetic circuit 24, this is not restrictive and that same dust cap 30 can be adapted to a loudspeaker having an outer-magnet type magnetic circuit.

This concept is also applicable to a small size loudspeaker having diaphragm 27 integrated with edge 29.

According to this structure, the loudspeaker is constructed by using dust cap 30 having sufficient rigidity and toughness as discussed in the first exemplary embodiment and the second exemplary embodiment, and the invention can thus improve a sound pressure level in the high register, to thereby provide clear and impressive quality sound in the high register. The loudspeaker can also reproduce firm and heavy bass sound in the low register.

As a whole, the loudspeaker can provide excellent quality of sound with high clarity and clearly-contoured outstanding auditory image localization. In addition, the loudspeaker realizes good tonal quality with feeling of low distortion.

As described above, dust cap 30 containing bamboo fibers according to this invention is of a natural material like the material made of coniferous trees used mainly for the conventional beaten paper dust cap 30. This invention thus makes possible for the loudspeaker to produce sound that is gentle to ears and excellent tonal quality by making the best use of the features of the natural materials.

This loudspeaker can also realize true and natural sound reproduction without being dominated by the uniformity of sound attributable to special tonal characteristics and resonance peculiar to synthetic materials and metallic materials. Therefore, there is rarely any reason for selecting applicable fields to which the loudspeakers are supplied, but the loudspeakers can be disseminated widely to many fields of sound making.

As another effect, this invention improves the toughness of dust cap 30, as compared to dust cap 30 composed only of a paper pulp, so as to make dust cap 30 superior in respect of both the quality and reliability. Accordingly, the invention can improve the reliability in various performances of the loudspeaker provided with this dust cap 30 such as a resistance to high input and moisture proofing reliability, which are important for loudspeakers used in motor vehicles, and maintain the aesthetic appearance and fine exterior stably for an extended period of time without much of discoloration.

The invention can thus achieve the loudspeaker of outstanding features in respect of both the quality and reliability. In addition, the invention can contribute greatly toward the environmental aspect and the cost performance.

In addition, the invention especially has the following advantageous effect when adopting not only dust cap 30 but also any one of diaphragm 27 made of the paper containing bamboo fibers obtained from bamboo tree of one year or older, of which the fibers are beaten to the extent of microfibrillated form, and another diaphragm 27 in one of the first exemplary embodiment and the second exemplary embodiment of this invention.

In this case, the loudspeaker becomes capable of reproducing natural sound of excellent quality from the low register to the high register without showing any variations of a notable degree in the tone since diaphragm 27 constructed primarily of bamboo fiber material delivers reproduction sound of a comparatively low register and dust cap 30 also constructed primarily of the same bamboo fiber material delivers reproduction sound of a comparatively high register.

Fifth Exemplary Embodiment

Figure 7:
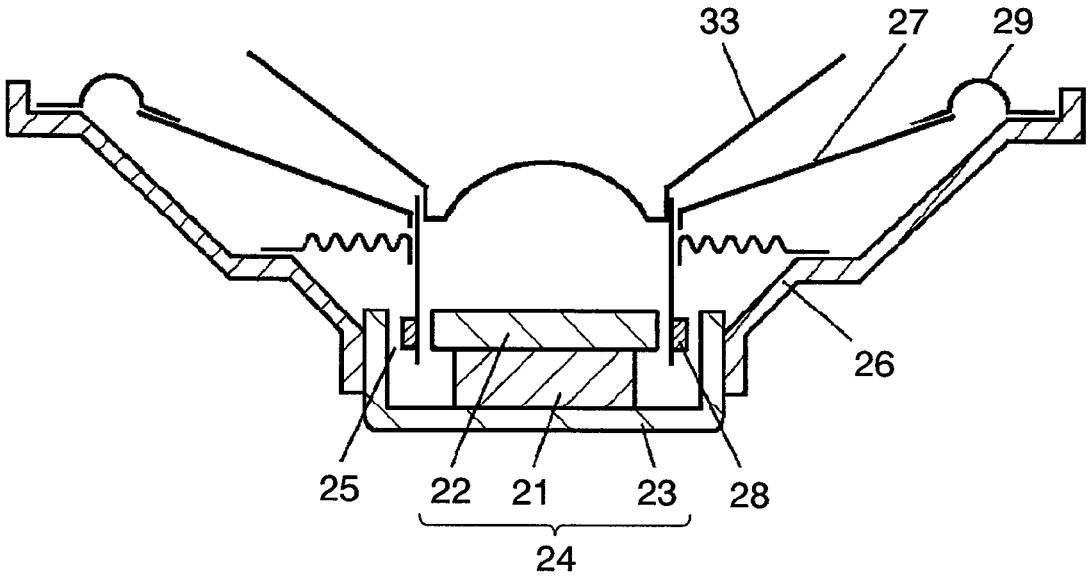
FIG. 7 is a sectional view of a loudspeaker according to a fifth exemplary embodiment of the present invention.

FIG. 7 is a sectional view of a loudspeaker according to the fifth exemplary embodiment of the present invention. As shown in FIG. 7, inner-magnet type magnetic circuit 24 is comprised of magnetized magnet 21 placed between upper plate 22 and yoke 23.

Frame 26 is connected to yoke 23 of this magnetic circuit 24. Diaphragm 27 is bonded at the periphery thereof to the outer fringe of this frame 26 through edge 29. One end of voice coil 28 is connected to a center portion of diaphragm 27, and the opposite end is coupled to magnetic circuit 24 in a manner to stay within magnetic gap 25.

Sub-cone 33 of the first exemplary embodiment of this invention is bonded to a front face portion of voice coil 28.

Although what is taught above is an example of the loudspeaker having inner-magnet type magnetic circuit 24, this is not restrictive and that same sub-cone 33 can be adapted to a loudspeaker having an outer-magnet type magnetic circuit.

This concept is also applicable to a small size loudspeaker having diaphragm 27 integrated with edge 29.

According to this structure, the loudspeaker is constructed by using sub-cone 33 having sufficient rigidity and toughness as discussed in the first exemplary embodiment, and the invention can thus improve a sound pressure level in the high register, to thereby provide clear and impressive quality sound in the high register. The loudspeaker can also reproduce firm and heavy bass sound in the low register.

As a whole, the loudspeaker can provide excellent quality of sound with high clarity and clearly-contoured outstanding auditory image localization. In addition, the loudspeaker realizes good tonal quality with feeling of low distortion.

As described above, sub-cone 33 containing bamboo fibers according to this invention is of a natural material like the material made of coniferous trees used mainly for the conventional beaten paper sub-cone 33. This invention thus makes possible for the loudspeaker to produce sound that is gentle to ears and excellent tonal quality by making the best use of the features of the natural materials.

This loudspeaker can also realize true and natural sound reproduction without being dominated by the uniformity of sound attributable to special tonal characteristics and resonance peculiar to synthetic materials and metallic materials. Therefore, there is rarely any reason for selecting applicable fields to which the loudspeakers are supplied, but the loudspeakers can be disseminated widely to many fields of sound making.

As another effect, this invention improves the toughness of sub-cone 33, as compared to sub-cone 33 composed only of a paper pulp, so as to make this sub-cone 33 superior in respect of both the quality and reliability. Accordingly, the invention can improve the reliability in various performances of the loudspeaker provided with this sub-cone 33 such as a resistance to high input and moisture proofing reliability, which are important for loudspeakers used in motor vehicles, and maintain the aesthetic appearance and fine exterior stably for an extended period of time without much of discoloration.

The invention can thus achieve the loudspeaker of outstanding features in respect of both the quality and reliability. In addition, the invention can contribute greatly toward the environmental aspect and the cost performance.

In addition, the invention especially has the following advantageous effect when adopting not only sub-cone 33 but also any one of diaphragm 27 made of the paper containing bamboo fibers obtained from bamboo tree of one year or older, of which the fibers are beaten to the extent of micro-fibrillated form, and diaphragm 27 in one of the first exemplary embodiment and the second exemplary embodiment of this invention.

In this case, the loudspeaker becomes capable of reproducing natural sound of excellent quality from the low register to the high register without showing any variations of a notable degree in the tone since diaphragm 27 constructed primarily of bamboo fiber material delivers reproduction sound of a comparatively low register and sub-cone 33 also constructed primarily of the same bamboo fiber material delivers reproduction sound of a comparatively high register.

Although what is taught above is an example of sub-cone 33 of a configuration including a dust cap in the center portion, this should not be considered as being restrictive and that the invention can also be adapted to a sub-cone of such configuration having an opening in the center but no dust cap.

In this instance, the loudspeaker may include another dust cap constructed of a material made primarily of the same bamboo fibers, or dust cap 30 illustrated in one of the first exemplary embodiment and the second exemplary embodiment of the present invention, so as to achieve sub-cone 33 and dust cap 30 to reproduce natural sound of excellent quality without variations of a notable extent in the tone.

It is also possible to construct a loudspeaker by using diaphragm 27 shown in one of the first and the second exemplary embodiments, dust cap 30 shown in one of the first and the second exemplary embodiments, and the sub-cone shown in the first exemplary embodiment of the present invention.

Sixth Exemplary Embodiment

Figure 8:
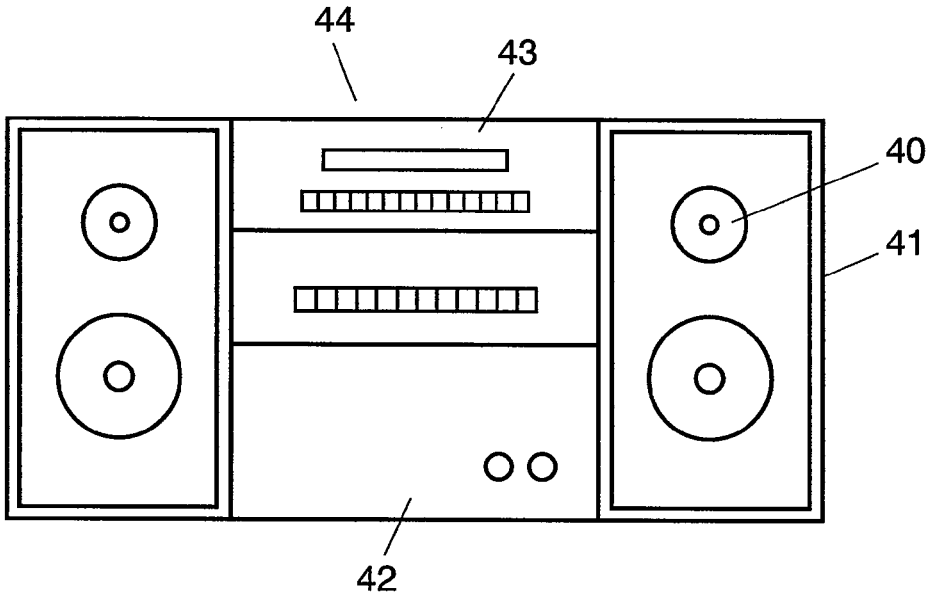
FIG. 8 is an exterior view of a mini audio component system representing an electronic apparatus according to a sixth exemplary embodiment of the present invention.

FIG. 8 is an exterior view of a mini audio component system representing an electronic apparatus according to the sixth exemplary embodiment of the present invention.

As shown in FIG. 8, mini component system 44 for audio signals constructed here as an electronic apparatus comprises a loudspeaker system having loudspeakers 40 of this invention built into enclosure 41, amplifier 42 having an amplification circuit for electric signals input to the loudspeakers, and player 43 for producing a source signal input to amplifier 42.

This structure can provide the mini component system capable of improving a sound pressure level in the high register, which had not been possible heretofore, and thereby producing clear and impressive quality sound in the high register.

In addition, the invention can realize the loudspeaker system having improved reliability in various performances such as a resistance to high input and moisture proofing reliability, and aesthetic appearance and fine exterior, which can be maintained stably for an extended period of time without much of discoloration. The invention can thus achieve the mini component system with outstanding features in respect of both the quality and reliability.

Furthermore, the invention can contribute greatly toward the environmental aspect and the cost performance.

The electronic apparatus covered by this invention is not limited to the mini component system illustrated above, but the invention can be adapted to any other apparatuses that use a loudspeaker. Such apparatuses include, for instance, a motor vehicle equipped with an audio function.

INDUSTRIAL APPLICABILITY

The loudspeaker diaphragms, loudspeaker dust caps, loudspeaker sub-cones, loudspeakers and electronic apparatuses of the present invention are applicable to a variety of electronic devices such as video and audio products and information and telecommunications equipment as well as apparatuses such as automobiles that require improvement of sound quality and performance characteristics, improvement of clarity by increasing a sound pressure level in the high register by means of highly rigid diaphragms, dust caps and sub-cones, and also good aesthetic appearance, high quality and reliability.

The invention claimed is:

1. A diaphragm for a loudspeaker made of a paper beaten of a material consisting primarily of a plant, wherein:

the beaten paper includes a material obtained from a bamboo tree aged one year or older, of which fibers are finely beaten to an extent of micro-fibrillated form;

wherein the bamboo fibers finely beaten to the extent of micro-fibrillated form have stems of no greater than 30 μm in diameter; and wherein surfaces of the stems are fibrillated into shaggy branches having diameters of 1 μm or less.

2. A diaphragm for a loudspeaker made of a paper beaten of a material consisting primarily of a plant, wherein the beaten paper includes:

a material obtained from a bamboo tree aged one year or older, of which fibers are finely beaten to an extent of micro-fibrillated form; and another material obtained from the bamboo tree aged one year or older, of which fibers are beaten to a degree larger than that of the micro-fibrillated form, wherein the bamboo fibers finely beaten to the extent of micro-fibrillated form have stems of no greater than 30 μm in diameter; and wherein surfaces of the stems are fibrillated into shaggy branches having diameters of 1 μm or less.

3. The diaphragm for a loudspeaker as in claim 2, wherein the beaten paper contains at least 40 wt % of the another material having the fibers beaten to the degree larger than that of the micro-fibrillated form.

4. The diaphragm for a loudspeaker in any of claim 1 or claim 2, wherein the bamboo fibers finely beaten to the extent of micro-fibrillated form have an average fiber length of at least 10 times an average fiber diameter.

5. The diaphragm for a loudspeaker in any of claim 1 or claim 2, wherein a content of the bamboo fibers finely beaten to the extent of micro-fibrillated form is between 0.5 wt % and 20 wt %.

6. The diaphragm for a loudspeaker in any of claim 1 or claim 2 further containing a poly-lactic acid.

7. The diaphragm for a loudspeaker in any of claim 1 or claim 2 further containing a crude rubber.

8. The diaphragm for a loudspeaker in any of claim 1 or claim 2 further containing a polyvinyl alcohol.

9. The diaphragm for a loudspeaker in claim 6 containing the poly-lactic acid from 1 wt % to 20 wt %.

10. The diaphragm for a loudspeaker in claim 8 containing the polyvinyl alcohol from 2 wt % to 8 wt %.

11. The diaphragm for a loudspeaker in any of claim 1 or claim 2 containing no coloring agent.

12. The diaphragm for a loudspeaker in any of claim 1 or claim 2, wherein a lignin content in the bamboo fibers is between 6 wt % and 15 wt %.

13. The diaphragm for a loudspeaker in any of claim 1 or claim 2 containing at least 2 wt % of the bamboo fibers finely beaten to the extent of micro-fibrillated form.

14. The diaphragm for a loudspeaker in claim 13, wherein at least 50% of the shaggy branches have diameters of 500 nm or less.

15. The diaphragm for a loudspeaker in claim 13, wherein the shaggy branches occupy at least 20% in volume of the bamboo fibers.

16. The diaphragm for a loudspeaker in claim 13 further containing a poly-lactic acid.

17. The diaphragm for a loudspeaker in claim 13 further containing a crude rubber.

18. A dust cap for a loudspeaker made of a paper beaten of a material consisting primarily of a plant, wherein:

the beaten paper includes a material obtained from a bamboo tree aged one year or older, of which fibers are finely beaten to an extent of micro-fibrillated form;

wherein the bamboo fibers finely beaten to the extent of micro-fibrillated form have stems of no greater than 30 μm in diameter; and wherein surfaces of the stems are fibrillated into shaggy branches having diameters of 1 μm or less.

19. A dust cap for a loudspeaker made of a paper beaten of a material consisting primarily of a plant, wherein the beaten paper includes:

a material obtained from a bamboo tree aged one year or older, of which fibers are finely beaten to an extent of micro-fibrillated form; and another material obtained from the bamboo tree aged one year or older, of which fibers are beaten to a degree larger than that of the micro-fibrillated form, wherein the bamboo fibers finely beaten to the extent of micro-fibrillated form have stems of no greater than 30 μm in diameter; and wherein surfaces of the stems are fibrillated into shaggy branches having diameters of 1 μm or less.

20. The dust cap for a loudspeaker as in claim 19, wherein the beaten paper contains at least 40 wt % of the another material having the fibers beaten to the degree larger than that of the micro-fibrillated form.

21. The dust cap for a loudspeaker in any of claim 18 or claim 19, wherein the bamboo fibers finely beaten to the extent of micro-fibrillated form have an average fiber length of at least 10 times an average fiber diameter.

22. The dust cap for a loudspeaker in any of claim 18 or claim 19, wherein a content of the bamboo fibers finely beaten to the extent of micro-fibrillated form is between 0.5 wt % and 20 wt %.

23. The dust cap for a loudspeaker in any of claim 18 or claim 19 further containing a poly-lactic acid.

24. The dust cap for a loudspeaker in any of claim 18 or claim 19 further containing a crude rubber.

25. The dust cap for a loudspeaker in any of claim 18 or claim 19 further containing a polyvinyl alcohol.

26. The dust cap for a loudspeaker in claim 23 containing the poly-lactic acid from 1 wt % to 20 wt %.

27. The dust cap for a loudspeaker in claim 25 containing the polyvinyl alcohol from 2 wt % to 8 wt %.

28. The dust cap for a loudspeaker in any of claim 18 or claim 19 containing no coloring agent.

29. The dust cap for a loudspeaker in any of claim 18 or claim 19, wherein a lignin content in the bamboo fibers is between 6 wt % and 15 wt %.

30. The dust cap for a loudspeaker in any of claim 18 or claim 19 containing at least 2 wt % of the bamboo fibers finely beaten to the extent of micro-fibrillated form.

31. The dust cap for a loudspeaker in claim 30, wherein at least 50% of the shaggy branches have diameters of 500 nm or less.

32. The dust cap for a loudspeaker in claim 30, wherein the shaggy branches occupy at least 20% in volume of the bamboo fibers.

33. A sub-cone for a loudspeaker made of a paper beaten of a material consisting primarily of a plant, wherein the beaten paper includes a material obtained from a bamboo tree aged one year or older, of which fibers are finely beaten to an extent of micro-fibrillated form, wherein the bamboo fibers finely beaten to the extent of micro-fibrillated form have stems of no greater than 30 μm in diameter; and wherein surfaces of the stems are fibrillated into shaggy branches having diameters of 1 μm or less.

34. A sub-cone for a loudspeaker made of a paper beaten of a material consisting primarily of a plant, wherein the beaten paper includes:

a material obtained from a bamboo tree aged one year or older, of which fibers are finely beaten to an extent of micro-fibrillated form; and another material obtained from the bamboo tree aged one year or older, of which fibers are beaten to a degree larger than that of the micro-fibrillated form, wherein the bamboo fibers finely beaten to the extent of micro-fibrillated form have stems of no greater than 30 μm in diameter; and wherein surfaces of the stems are fibrillated into shaggy branches having diameters of 1 μm or less.

35. The sub-cone for a loudspeaker as in claim 34, wherein the beaten paper contains at least 40 wt % of the another material having the fibers beaten to the degree larger than that of the micro-fibrillated form.

36. The sub-cone for a loudspeaker in any of claim 33 or claim 34, wherein the bamboo fibers finely beaten to the extent of micro-fibrillated form have an average fiber length of at least 10 times an average fiber diameter.

37. The sub-cone for a loudspeaker in any of claim 33 or claim 34, wherein a content of the bamboo fibers finely beaten to the extent of micro-fibrillated form is between 0.5 wt % and 20 wt %.

38. The sub-cone for a loudspeaker in any of claim 33 or claim 34 further containing a poly-lactic acid.

39. The sub-cone for a loudspeaker in any of claim 33 or claim 34 further containing a crude rubber.

40. The sub-cone for a loudspeaker in any of claim 33 or claim 34 further containing a polyvinyl alcohol.

41. The sub-cone for a loudspeaker in claim 38 containing the poly-lactic acid from 1 wt % to 20 wt %.

42. The sub-cone for a loudspeaker in claim 40 containing the polyvinyl alcohol from 2 wt % to 8 wt %.

43. The sub-cone for a loudspeaker in any of claim 33 or claim 34 containing no coloring agent.

44. The sub-cone for a loudspeaker in any of claim 33 or claim 34, wherein a lignin content in the bamboo fibers is between 6 wt % and 15 wt %.

45. The sub-cone for a loudspeaker in any of claim 33 or claim 34 containing at least 2 wt % of the bamboo fibers finely beaten to the extent of micro-fibrillated form.

* * * * *

UNITED STATES PATENT AND TRADEMARK OFFICE

CERTIFICATE OF CORRECTION

PATENT NO. : 8,199,964 B2
APPLICATION NO. : 11/909038
DATED : June 12, 2012
INVENTOR(S) : Kazuyoshi Mimura et al.

It is certified that error appears in the above-identified patent and that said Letters Patent is hereby corrected as shown below:

On the Title page:

Item [75], Inventors: "Yoshiyuku Takahashi" should read --Yoshiyuki Takahashi--.

On Page 2, Item [56], References Cited:

FOREIGN PATENT DOCUMENTS
"JP 6-66196 9/2005" should read --JP 6-66196 9/1994--.

On Page 2, Item [56], References Cited, line 8:

OTHER PUBLICATIONS
"Agricuture, (Recieved" should read --Agriculture, (Received--.

On Page 2, Item [56], References Cited, line 10:

OTHER PUBLICATIONS
"Chineese Office Action for 2007800000812.7" should read --Chinese Office Action for 200780000052.7--.

Signed and Sealed this
Fourth Day of September, 2012

David J. Kappos

David J. Kappos
*Director of the United States Patent and Trademark Office*